US008118479B2

(12) United States Patent
van Elderen et al.

(10) Patent No.: US 8,118,479 B2
(45) Date of Patent: Feb. 21, 2012

(54) APPARATUS FOR HEAT EXCHANGE WITH RADIAL MIXING

(75) Inventors: Unnis Maria van Elderen, Waddinxveen (NL); Theodorus Gijsbertus Ravensberg, Boskoop (NL); Ronnie Johannes Maria van Heijningen, Wateringen (NL)

(73) Assignee: Goudsche Machinefabriek B.V., Wateringen (NL)

( * ) Notice: Subject to any disclaimer, the term of this patent is extended or adjusted under 35 U.S.C. 154(b) by 813 days.

(21) Appl. No.: 12/144,452

(22) Filed: Jun. 23, 2008

(65) Prior Publication Data

US 2009/0052274 A1 Feb. 26, 2009

(30) Foreign Application Priority Data

Jun. 22, 2007 (NL) ..... 1034022

(51) Int. Cl.
*B01F 7/00* (2006.01)
*B01F 11/00* (2006.01)

(52) U.S. Cl. ..... 366/301; 366/318; 366/321; 366/335

(58) Field of Classification Search ..... 366/301, 366/318, 320, 321, 332–335
See application file for complete search history.

(56) References Cited

U.S. PATENT DOCUMENTS

| | | | | |
|---|---|---|---|---|
| 2,624,552 | A | | 1/1953 | Rose |
| 3,500,901 | A | | 3/1970 | Root |
| 3,548,926 | A | | 12/1970 | Archer |
| 3,613,777 | A | | 10/1971 | Nara |
| 3,730,486 | A | | 5/1973 | Hayashi |
| 4,039,024 | A | | 8/1977 | List |
| 4,416,606 | A | * | 11/1983 | Sugano et al. ..... 425/202 |
| 4,556,324 | A | * | 12/1985 | Tynan ..... 366/85 |
| 4,775,239 | A | * | 10/1988 | Martinek et al. ..... 366/2 |
| 4,950,081 | A | * | 8/1990 | List ..... 366/85 |
| 5,151,739 | A | * | 9/1992 | Hediger ..... 399/256 |
| 5,220,382 | A | * | 6/1993 | Hediger ..... 399/256 |
| 5,230,562 | A | * | 7/1993 | Nishimi et al. ..... 366/298 |
| 5,669,710 | A | * | 9/1997 | Schebesta et al. ..... 366/97 |
| 5,791,779 | A | * | 8/1998 | Smith, Sr. ..... 366/297 |
| 6,183,560 | B1 | * | 2/2001 | Sarrasin ..... 118/417 |
| 6,322,244 | B1 | * | 11/2001 | Marchesini et al. ..... 366/325.5 |
| 7,871,024 | B2 | * | 1/2011 | Peeters et al. ..... 239/667 |

FOREIGN PATENT DOCUMENTS

| | | |
|---|---|---|
| DE | 1923870 | 2/1970 |
| EP | 0231584 | 8/1987 |
| FR | 1294663 | 5/1962 |
| JP | 58-11794 | 7/1983 |
| JP | 60178284 | 9/1985 |

* cited by examiner

*Primary Examiner* — Joseph Del Sole
*Assistant Examiner* — Nahida Sultana
(74) *Attorney, Agent, or Firm* — Swanson & Bratschun, L.L.C.

(57) ABSTRACT

An apparatus for heat exchange with radial mixing comprises a trough with two rotatably arranged shafts extending alongside each other, which shafts are each provided with paddles spaced apart in an axial direction with an intermediate distance. The paddles extend substantially in a radial plane with respect to the shafts, and extend in a circumferential direction over at least a part of the circumference. In the circumferential direction, the paddles are at least partly wedge-shaped. Upon opposite rotation of the shafts, successive paddles mesh alternately, thereby forming a gap narrowing again and again. Per shaft, successive paddles in an axial direction are staggered relative to each other in circumferential direction through an angle.

10 Claims, 8 Drawing Sheets

APPARATUS FOR HEAT EXCHANGE WITH RADIAL MIXING

RELATED APPLICATIONS

This application claims priority to Netherlands application number 1034022, filed on Jun. 22, 2007, entitled "Apparatus for Heat Exchange with Radial Mixing" which is incorporated herein by reference in its entirety.

TECHNICAL FIELD

This invention relates to an apparatus comprising a trough with two rotatably arranged shafts extending alongside each other, which shafts are each provided with paddles spaced apart in axial direction with an intermediate distance, which extend substantially in a radial plane with respect to the shafts and which extend in circumferential direction over at least a part of the circumference and which are at least partly wedge-shaped in circumferential direction, while upon opposite rotation of the shafts successive paddles in axial direction mesh alternately, thereby forming a gap narrowing again and again, which is pitchless in axial direction.

BACKGROUND

Devices as described above are generally known. One construction is for instance described in JP 58 117 954 in the name of Nara Machinery Company Ltd. In the apparatus, due to the absence of axial pitch in the gap, the product is mixed substantially in radial direction, as forces in axial direction are virtually absent. Transport in axial direction is not imposed by the paddles, but occurs under the influence of an external force, for instance under the influence of gravity upon inclined arrangement of the trough and/or by pressure differences resulting from continuous supply of product.

The paddles and/or the trough are arranged for being in heat exchanging contact with the product. In the apparatus, the product may be cooled, dried and/or heated, with use being made of radial mixing of the product.

In such an apparatus, per mixing shaft, all mixing paddles are placed in line in order to prevent axial forces by the paddles on the product as much as possible. A drawback of such a set-up is that peak load on the shafts and drive can occur. This is the case especially with products having a high density and/or viscosity, as for instance dehydrated sewage sludge.

SUMMARY

An object of the invention is to provide an apparatus of the type mentioned in the opening paragraph by which one or more of the disadvantages mentioned can be prevented while maintaining one or more of the advantages. To that end, one embodiment of an apparatus according to the invention includes per shaft successive paddles in axial direction that are staggered relative to each other in circumferential direction through an angle. As a result, the paddles per shaft are not led into the product all at the same time and the peak load is distributed during the rotation of the shaft, while the axial forces on the product remain limited.

In an embodiment arranging successive paddles per shaft in the form of a helix, the peak load is spread out over a rotation of the shaft. This results in a more or less uniformly distributed loading of the shaft and drive.

In an embodiment with successive paddles per shaft staggered through an angle of about 15° at a maximum, the axial forces that may be exerted on the product by the paddles can remain limited.

DETAILED DESCRIPTION

Figure 1:
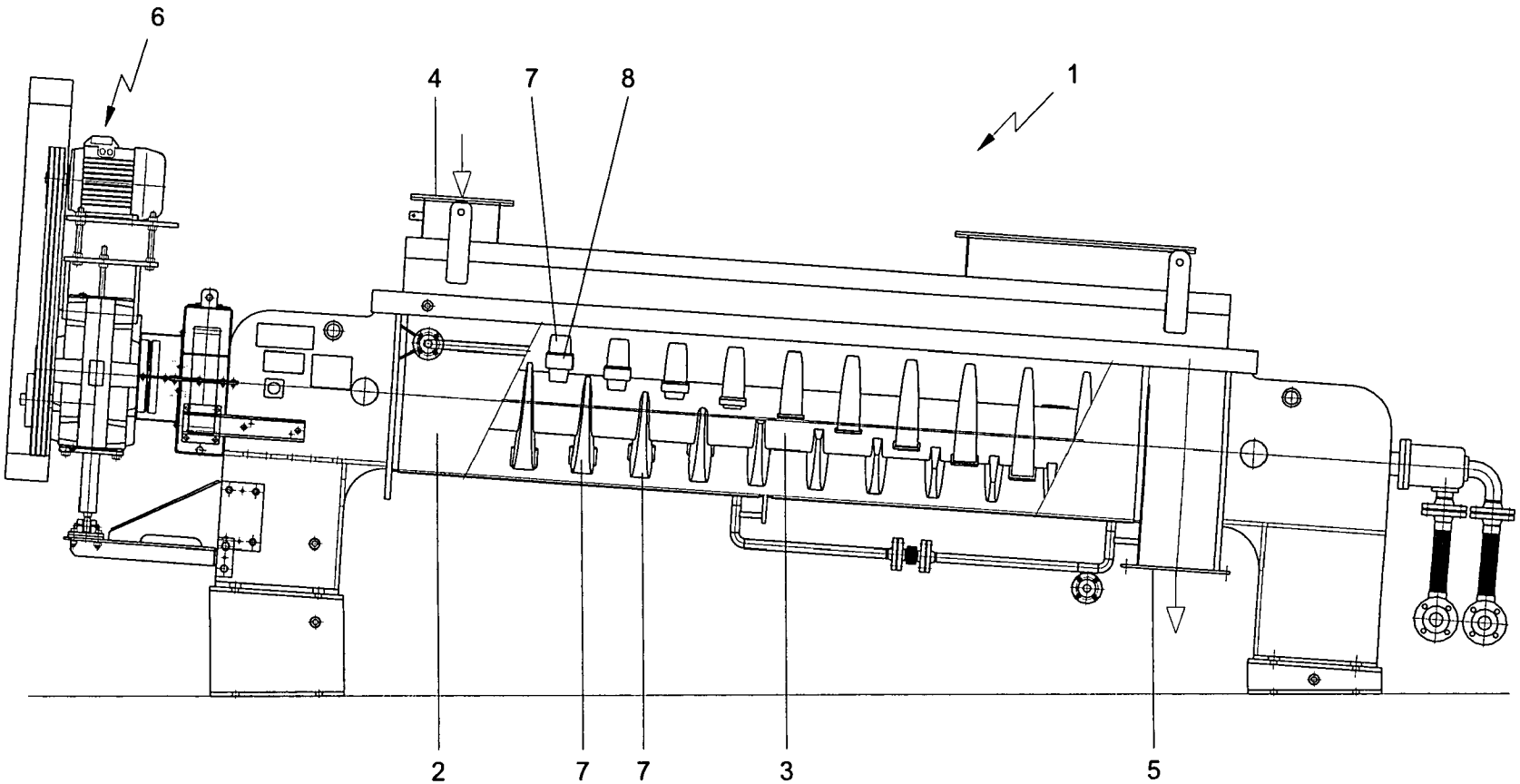
FIG. 1 shows a schematic side elevation of an apparatus according to the invention.

It is noted that the figures are only schematic representations of preferred embodiments of the invention which are described by way of non-limiting exemplary embodiments. In the figures, the same or corresponding parts are represented with the same reference numerals.

FIG. 1 shows an apparatus 1 which comprises a trough 2. In FIG. 1 the trough 2 is partly cut through, so that a shaft 3 can be seen. The trough 2 comprises two rotatably arranged shafts 3, extending alongside each other. The apparatus 1 is provided with an inlet 4 along which the product to be treated is fed into the trough 2, and an outlet 5 along which the product is discharged from the trough 2. The shafts 3 are arranged in a direction that corresponds to a path between the inlet 4 and the outlet 5 of the trough 2. The shafts 3 are driven by means of a drive 6.

The shafts 3 are provided with paddles 7, spaced apart in axial direction with an intermediate distance, which are set up in the form of a helix, as shown in FIG. 1. The paddles 7 extend in a circumferential direction substantially in a radial plane over a part of the circumference. The paddles 7 have at least partly a wedge-shaped contour, as can be seen in FIG. 9.

Figure 8:
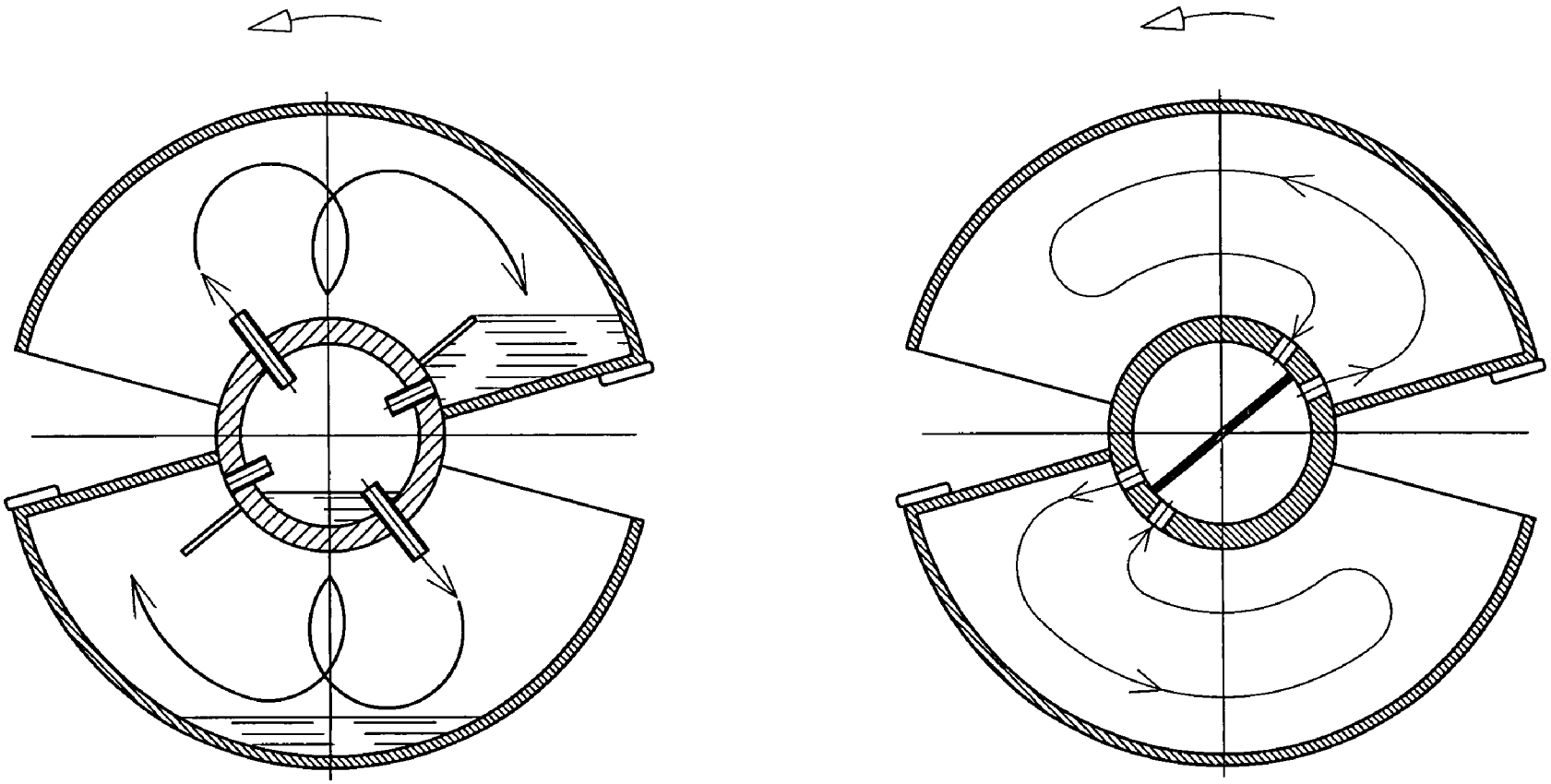
FIG. 8 shows a schematic front view of paddles arranged for heat exchanging contact.

In a common application, the paddles 7 are arranged for heat exchanging contact with the product. To this end, the paddles 7 may be of hollow design, as shown in FIG. 8, and may be filled with steam or with a hot or cold liquid. The apparatus 1 can then be used to dry, cool and/or heat the product. Drying, cooling or heating is rendered more efficient by making use of radial mixing of the product. During operation, product is supplied via the inlet 4 to the trough 2. Owing to the helical configuration, upon opposite rotation of the shafts 3, successive paddles 7 mesh alternately, thereby forming a narrowing gap. As a result, the product is mixed in a radial direction and the product is pressed against the paddles 7 to enable a best possible heat exchanging contact between product and paddles 7 to be achieved. The narrowing gap is pitchless in axial direction and hence does not impose any transport movement in an axial direction on the product to be treated.

Transport of the product to be treated in an axial direction along the shafts 3 is provided for by a transport provision external with respect to the shafts 3 and paddles 7. This external transport provision comprises in (this exemplary) one embodiment a plug flow imposed via a supply. By sustained continuous supply of product via the inlet 4, the product is pushed through the trough 2 to the outlet 5, so that a so-called plug flow is created. To further facilitate the axial transport of products, the external transport provision in this embodiment comprises furthermore a placement of the trough at a slope. The bottom of the trough is arranged at an inclination with respect to the shafts 3, so that the product to be treated flows from inlet 4 to outlet 5 under the influence of gravity.

Figure 9:
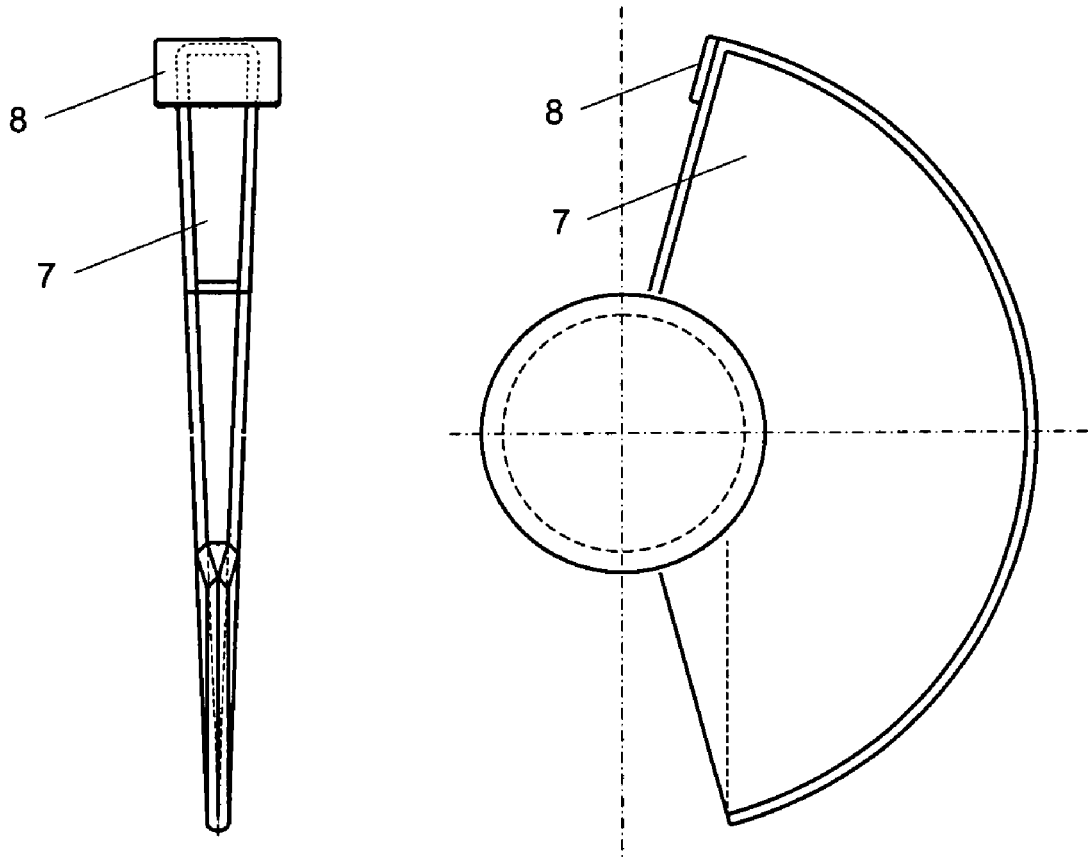
FIG. 9 shows a schematic top plan and side view of a paddle.

In an advantageous embodiment, the paddles 7 are provided at the ends thereof with a carrier plate 8, as shown in FIG. 9. By the carrier plate 8, the slit left in the product by the paddle 7 is disturbed, so that a more optimal radial mixing can be achieved.

Figure 4:
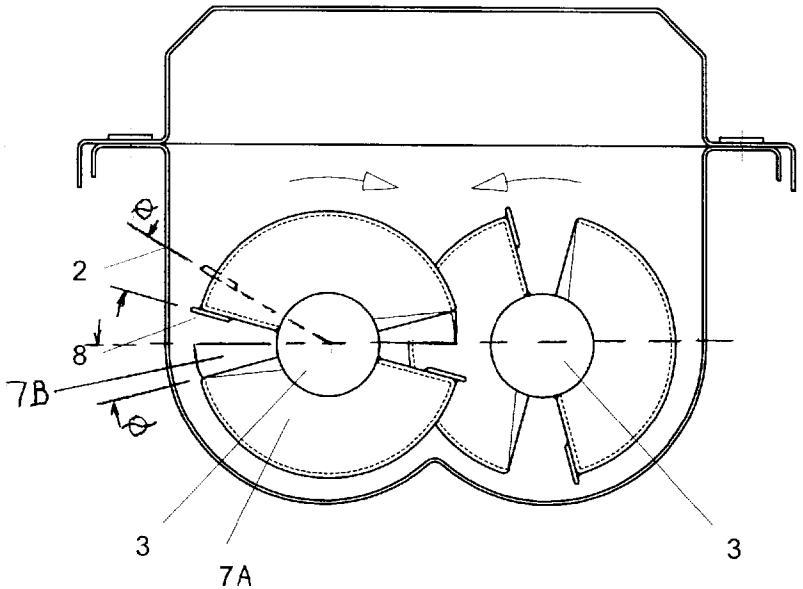
FIG. 4 shows a schematic front view of shafts with paddles in the first configuration.

Referring to FIG. 4, angle θ between successive paddles 7A, 7B on a shaft in this example is at most approximately 15°, being for instance approximately 10°. Given such a small angle, the load can be distributed comparatively uniformly over the shaft 3 and the axial force of the paddles 7 on the product can remain small, so that only mixing in radial direction will take place.

Figure 2:
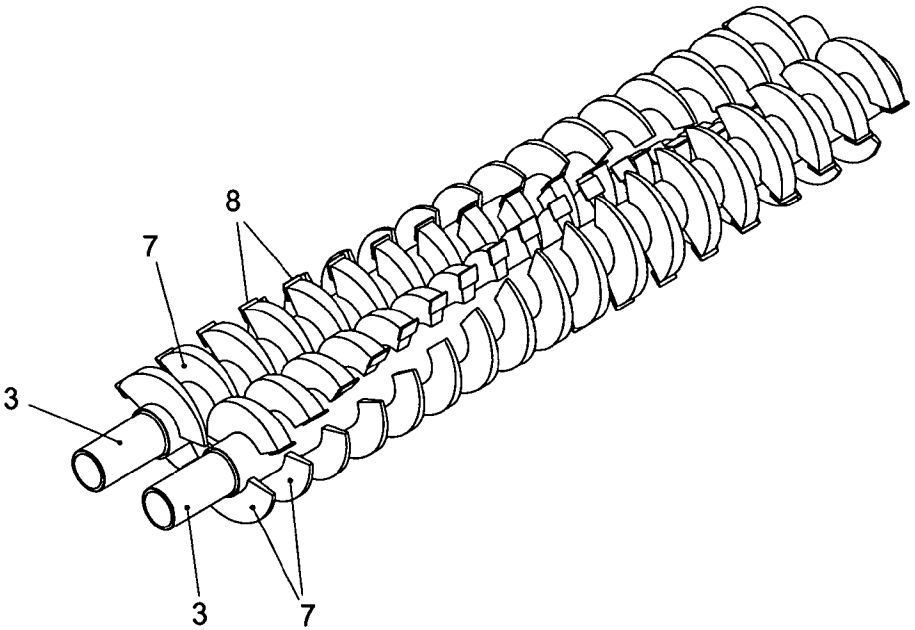
FIG. 2 shows a schematic top plan and perspective view of shafts with helically arranged paddles in a first configuration.
Figure 2:
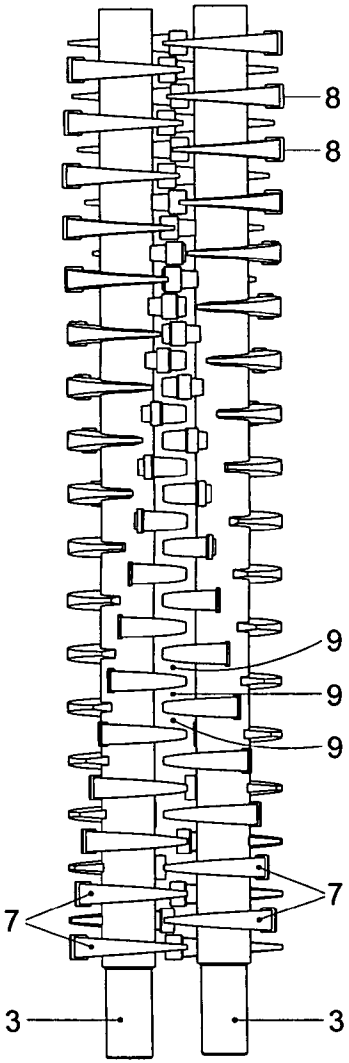
Figure 3:
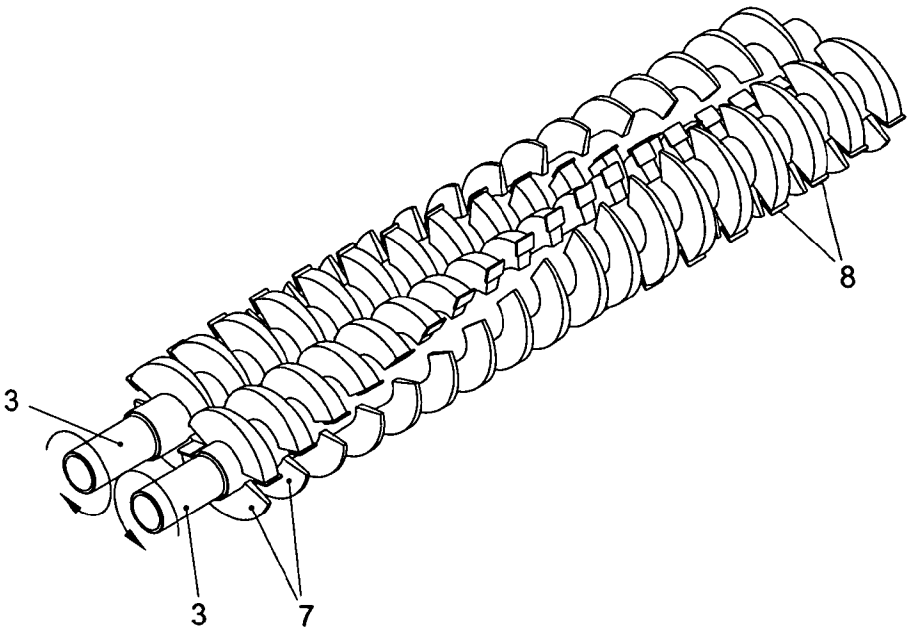
FIG. 3 shows a schematic top plan and perspective view of shafts with helically arranged paddles in a second configuration.
Figure 3:
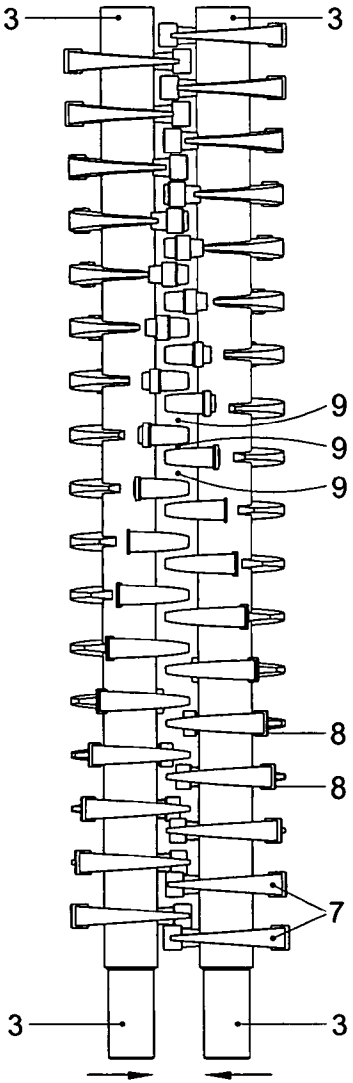
Figure 6:
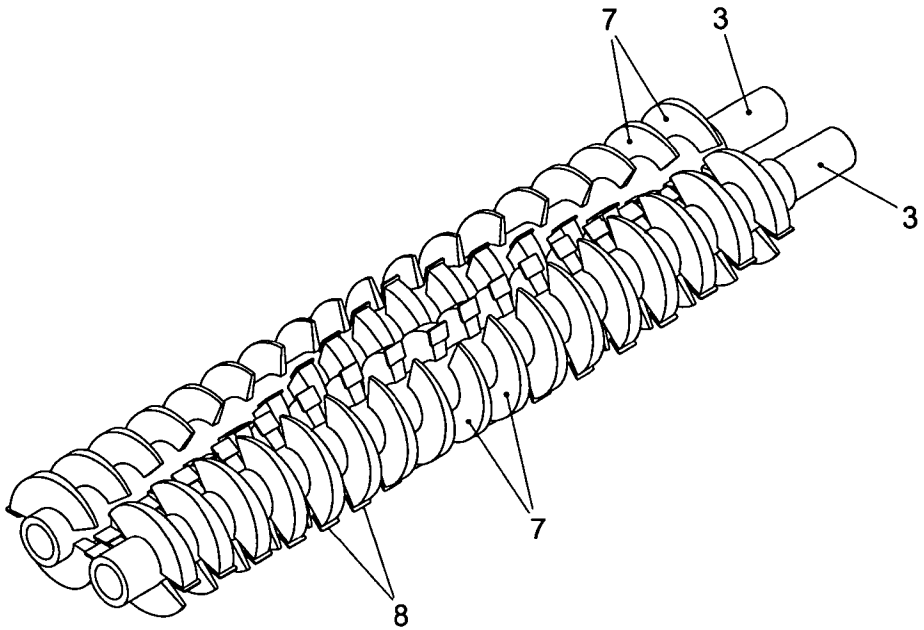
FIG. 6 shows a schematic top plan and perspective view of shafts with paddles arranged in the form of a wavy line.
Figure 6:
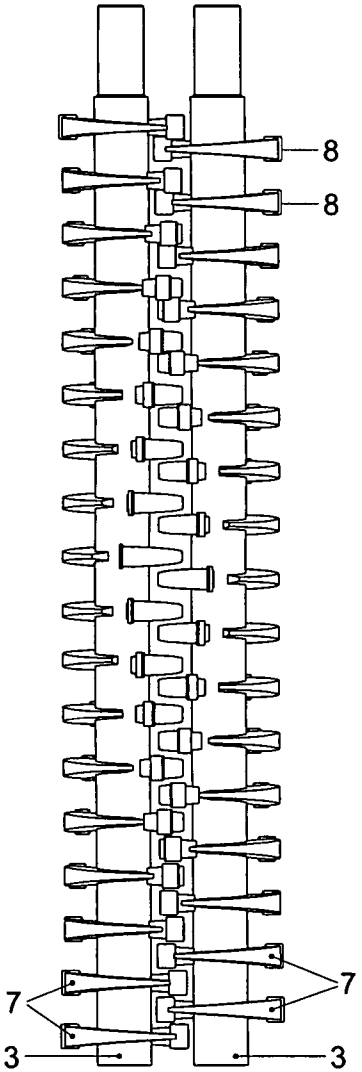
Figure 7:
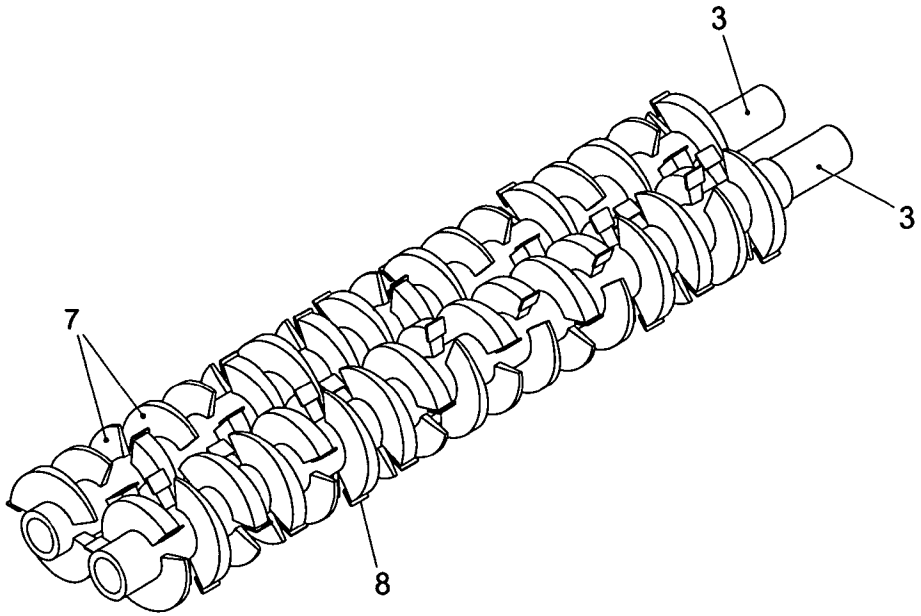
FIG. 7 shows a schematic top plan and perspective view of shafts with randomly arranged paddles.
Figure 7:
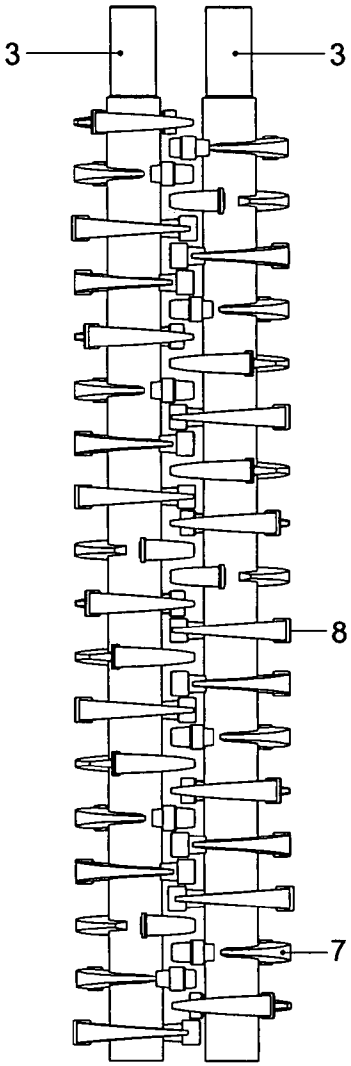

FIG. 2, FIG. 3, FIG. 6 and FIG. 7 show different embodiments in which the paddles 7 may be arranged. The successive paddles 7 may be arranged in the form of a helix, as shown in FIG. 1, FIG. 2, and FIG. 3. Also, successive paddles 7 may be arranged in the form of a wave, as shown in FIG. 6. In another embodiment, successive paddles 7 may be arranged at random, as shown in FIG. 7.

Figure 5:
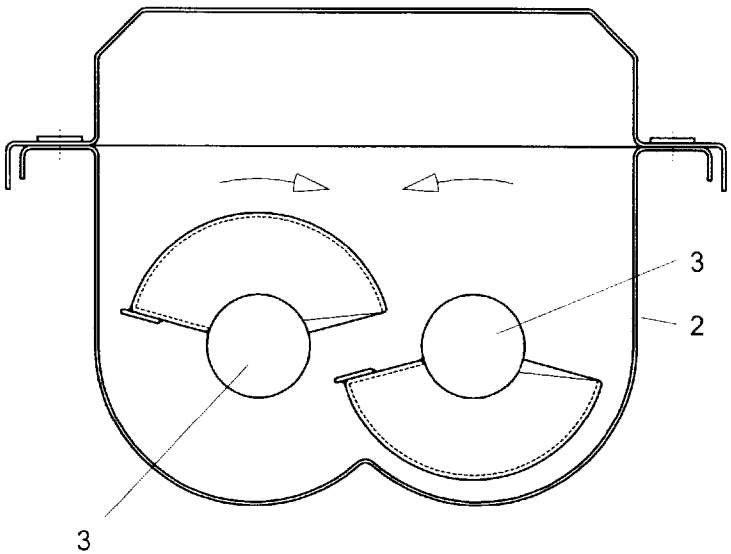
FIG. 5 shows a schematic front view of shafts with paddles in the second configuration.

Such arrangements may be implemented in two possible configurations: a configuration whereby per mixing shaft in one and the same radial plane two or more paddles are arranged, the so-called paired configuration as shown in FIG. 3 and FIG. 4, and a configuration whereby per mixing shaft in one and the same radial plane one paddle is arranged, the so-called staggered configuration as shown in FIG. 2 and FIG. 5.

In the paired configuration (FIG. 3 and FIG. 4), in circumferential direction, per shaft, in one and the same radial plane, in this example two paddles are arranged. Optionally, in circumferential direction, per shaft, also for instance three paddles may be provided in the same radial plane. Upon opposite rotation of the shafts 3, the paddles 7 mesh alternately. Between the paddle 7 of the first shaft 3 and the next paddle 7 of the second shaft 3, a narrowing gap 9 is formed. The gap 9 opens wide at the beginning of the paddles 7 and closes narrow at the carrier plate 8 at the end of the paddles 7. In the paired configuration, per shaft 3 the next paddles 7 are in the same radial plane as their preceding paddles 7, so that after closure of one gap, the next gap likewise opens in the same radial plane.

In the staggered configuration (FIG. 2 and FIG. 5), in a respective radial plane, there is per shaft 3 only one paddle 7. The narrowing gap 9 is formed between a paddle 7 of the first shaft 3 and a successive paddle 7 of the second shaft 3. The gap 9 opens wide at meshing of the wedge-shaped paddles 7 and closes narrow at the carrier plates 8 of the paddles 7. During the rotation, per shaft 3 the next paddle 7 is displaced in axial direction relative to the preceding paddle 7, so that during rotation the next gap 9 is staggered in axial direction relative to the gap formed earlier during rotation.

It will be clear that the invention is not limited to the embodiments represented here. Many variants are possible and are understood to be within the scope of the invention as defined in the following claims.

The invention claimed is:

1. An apparatus comprising a trough with two rotatably arranged shafts extending alongside each other, which shafts are each provided with paddles which are spaced apart in axial direction with an intermediate distance, which extend substantially in a radial plane with respect to the shafts and which extend in circumferential direction over at least a part of the circumference and which are at least partly wedge-shaped in circumferential direction, while upon opposite rotation of the shafts successive paddles mesh alternately, thereby forming a gap narrowing again and again, which is pitchless in the axial direction, wherein the per shaft successive paddles in the axial direction are staggered relative to each other in the circumferential direction through an angle of about 15° at a maximum.

2. The apparatus according to claim 1, further comprising successive paddles per shaft in axial direction are arranged in the form of a helix.

3. The apparatus according to claim 1, further comprising the shafts extending in a direction that corresponds to a path between an inlet and an outlet of the trough.

4. The apparatus according to claim 1, further comprising the end of at least one paddle is provided with a carrier plate.

5. The apparatus according to claim 1, further comprising the paddles being configured to promote heat exchange with a product to be treated.

6. The apparatus according to claim 1, further comprising the trough being configured to promote heat exchange with a product to be treated.

7. The apparatus according to claim 1, further comprising the per shaft in each case having at least two mixing paddles situated in the same radial plane.

8. The apparatus according to claim 1, further comprising transport of a product to be treated in a direction along the shafts being provided by a transport provision external with respect to the shafts and paddles.

9. The apparatus according to claim 8, further comprising the transport provision comprising a slope of the trough.

10. The apparatus according to claim 8, further comprising the transport provision comprising a plug flow imposed via a supply of the product.

* * * * *